US008567361B2

(12) United States Patent
Grüberger

(10) Patent No.: US 8,567,361 B2
(45) Date of Patent: Oct. 29, 2013

(54) VALVE DRIVE FOR AN INTERNAL COMBUSTION ENGINE

(75) Inventor: Joachim Grüberger, Sachsenheim (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 78 days.

(21) Appl. No.: 13/412,158

(22) Filed: Mar. 5, 2012

(65) Prior Publication Data

US 2012/0227697 A1 Sep. 13, 2012

(30) Foreign Application Priority Data

Mar. 7, 2011 (DE) ..... 10 2011 001 125

(51) Int. Cl.
*F01L 1/34* (2006.01)

(52) U.S. Cl.
USPC ..... 123/90.18; 123/90.16; 123/90.6; 29/888.1

(58) Field of Classification Search
USPC ..... 123/90.16, 90.18, 90.27, 90.31, 90.6; 29/888.1
See application file for complete search history.

(56) References Cited

U.S. PATENT DOCUMENTS

| | | | | |
|---|---|---|---|---|
| 8,230,833 | B2 * | 7/2012 | Werler et al. | 123/90.6 |
| 2010/0242873 | A1 | 9/2010 | Meintschel et al. | |
| 2010/0251982 | A1 | 10/2010 | Elendt et al. | |

FOREIGN PATENT DOCUMENTS

| | | | |
|---|---|---|---|
| DE | 196 11 641 | C1 | 6/1997 |
| DE | 10 2006 024 795 | A1 | 11/2007 |
| DE | 10 2007 054 979 | A1 | 5/2009 |
| DE | 10 2008 036 462 | A1 | 2/2010 |
| DE | 10 2008 049 103 | A1 | 4/2010 |
| DE | 10 2008 060 166 | A1 | 6/2010 |
| DE | 10 2010 013 216 | A1 | 10/2010 |

OTHER PUBLICATIONS

German Search Report, mailed Jan. 20, 2012 (w/partial English Translation).

* cited by examiner

*Primary Examiner* — Ching Chang
(74) *Attorney, Agent, or Firm* — RatnerPrestia

(57) ABSTRACT

A valve drive for an internal combustion engine, wherein in order to activate gas exchange valves at least one camshaft having at least one sliding cam which can be displaced axially on the camshaft is provided, wherein the respective sliding cam has a sliding block section with a plurality of grooves which are formed on an outer lateral face and are positioned one behind the other on the circumference, wherein in order to bring about displacement of the respective sliding cam an actuator is provided with a first pin for displacement in the two directions about a first axial segment and a second pin for displacement in the two directions about a second axial segment. The sliding block section is manufactured in certain sections from a material with a relatively high electrical conductivity and in certain sections from a material with a relatively low electrical conductivity.

10 Claims, 2 Drawing Sheets

VALVE DRIVE FOR AN INTERNAL COMBUSTION ENGINE

CROSS-REFERENCE TO RELATED APPLICATION

This U.S. patent application claims priority to German Patent Application DE 10 2011 001 125.0, filed Mar. 7, 2011, which is incorporated by reference herein in its entirety.

FIELD OF THE INVENTION

The invention relates to a valve drive for an internal combustion engine having a plurality of cylinders.

BACKGROUND OF THE INVENTION

In modern internal combustion engines, variable valve drives, with which different valve strokes can be set at the gas exchange valves of the internal combustion engine, are used to optimize the charge movement in the combustion chamber. DE 196 11 641 C1, which is incorporated by reference, discloses a valve drive of an internal combustion engine which permits a gas exchange valve to be activated with a plurality of different stroke curves. For this purpose, a sliding cam having a plurality of cam tracks is mounted in a rotationally fixed but axially displaceable fashion on the camshaft, which sliding cam has a stroke contour into which an activation element in the form of a pin for generating axial displacement of the cam engages. The axial displacement of the cam causes a different valve stroke to be set at the respective gas exchange valve.

DE 10 2008 060 166 A1, which is incorporated by reference, discloses a valve drive in which a sliding cam which is mounted in a rotationally fixed but axially displaceable fashion on a camshaft has a sliding block section with a plurality of grooves, and in which in order to bring about axial displacement of the sliding cam an actuator having a plurality of pins which can be activated is provided. The sliding block section has a first, right-handed groove and a second, left-handed groove which are arranged one next to the other on the circumference of the sliding block section and merge with a common run-out groove. The pins of the actuator interact with the grooves of the sliding block section.

In addition, a valve drive is already known in which the grooves of the sliding block section are positioned one behind the other on the circumference of the sliding block section, specifically a first groove for axial displacement of the sliding cam in a first direction and a second groove for axial displacement of the sliding cam in an opposing second direction. In this valve drive, the actuator also has a plurality of pins which can be activated in order to bring about axial displacement of the sliding cam, specifically a first pin for axial displacement of the sliding cam in the two directions about a first axial segment and a second pin for axial displacement of the sliding cam in the two directions about a second axial segment.

For the engine control of an internal combustion engine having such a valve drive which has at least one displaceable sliding cam, it is necessary to have knowledge of the relative position of the sliding cam on the camshaft and therefore of the cam tracks relative to the gas exchange valve of the internal combustion engine which is to be activated. Hitherto, it was difficult to detect in a certain and reliable way the relative position of the sliding cam on the camshaft and therefore the relative position of the cam tracks with respect to the gas exchange valve which is to be activated.

SUMMARY OF THE INVENTION

Disclosed herein is an improvement to a valve drive for an internal combustion engine having a plurality of cylinders in such a way that a relative position of the sliding cam on the camshaft and therefore a relative position of the cam tracks with respect to the gas exchange valve which is to be activated can be detected in a certain and reliable way. This object is achieved by means of a valve drive for an internal combustion engine having a plurality of cylinders, wherein in order to activate gas exchange valves of the internal combustion engine at least one camshaft having at least one sliding cam which can be displaced axially on the camshaft is provided, wherein the respective sliding cam has a sliding block section with a plurality of grooves which are formed on an outer lateral face of the sliding block section and are positioned one behind the other on the circumference of the sliding block section, specifically with a first groove for axial displacement of the sliding cam in a first direction and with a second groove for axial displacement of the sliding cam in an opposing second direction, wherein in order to bring about axial displacement of the respective sliding cam an actuator is provided with a plurality of pins which can be activated, specifically with a first pin for axial displacement of the sliding cam in the two directions about a first axial segment and with a second pin for axial displacement of the sliding cam in the two directions about a second axial segment, and wherein for axial displacement of the sliding cam both the first pin and the second pin are released from the actuator and moved axially radially inward in the radial direction of the sliding cam in such a way that one of the pins projects into a groove of the sliding block section, while the respective other pin bears on the radially outer lateral face of the sliding block section, characterized in that the sliding block section is manufactured in certain sections from a material with a relatively high electrical conductivity and in certain sections from a material with a relatively low electrical conductivity.

The sliding block section of the valve drive according to aspects of the invention is manufactured in certain sections from a material with a relatively high electrical conductivity and in certain sections from a material with a relatively low electrical conductivity.

According to aspects of the invention, the sliding block section of the sliding cam is fabricated from different materials, specifically in certain sections from an electrically conductive material and in certain sections from an electrically insulating material. Through the interaction of these sections or regions of the sliding block section, which are fabricated from different materials, with the pins of the actuator, which are preferably fabricated from an electrically conductive material, it is possible to detect in a certain, reliable and simple way a relative position of the sliding cam on the camshaft and therefore a relative position of the cam tracks with respect to the gas exchange valve which is to be activated.

According to one advantageous development of the invention, the sliding block section is formed in the region of its grooves and axially next to the grooves from a preferably metallic material with a relatively high electrical conductivity, wherein the sliding block section is formed in the region of its axial ends from a material with a relatively low electrical conductivity, preferably from a plastic.

The above configuration of the sliding block section of the sliding cam is particularly simple and particularly preferred. It permits in a particularly simple way the relative position of the sliding cam on the camshaft to be determined, and therefore permits the relative position of the cam tracks with respect to the gas exchange valve which is to be activated to be determined.

According to a further advantageous development of the invention, both pins of the actuator are connected to an electrical test voltage potential via a preferably common electrical feed line, wherein the level of the flowing electrical test current is dependent on whether the pins both bear on an electrically conductive region of the sliding block section or whether one of the pins bears on an electrically insulating region of the sliding block section. In addition, a preferably common sensor is assigned to the two pins of the actuator, with the aid of which sensor it is possible to detect whether one of the pins projects into one of the grooves. This configuration of the actuator is particularly simple and is therefore preferred for detecting the relative position of the sliding cam on the camshaft and therefore the relative position of the cam tracks with respect to the gas exchange valve which is to be activated.

BRIEF DESCRIPTION OF THE DRAWING FIGURES

Further features and feature combinations emerge from the description. Specific exemplary embodiments of the invention are illustrated in simplified form in the drawing and are explained in more detail in the following description, in which.

DETAILED DESCRIPTION OF THE DRAWING FIGURES

Figure 1:
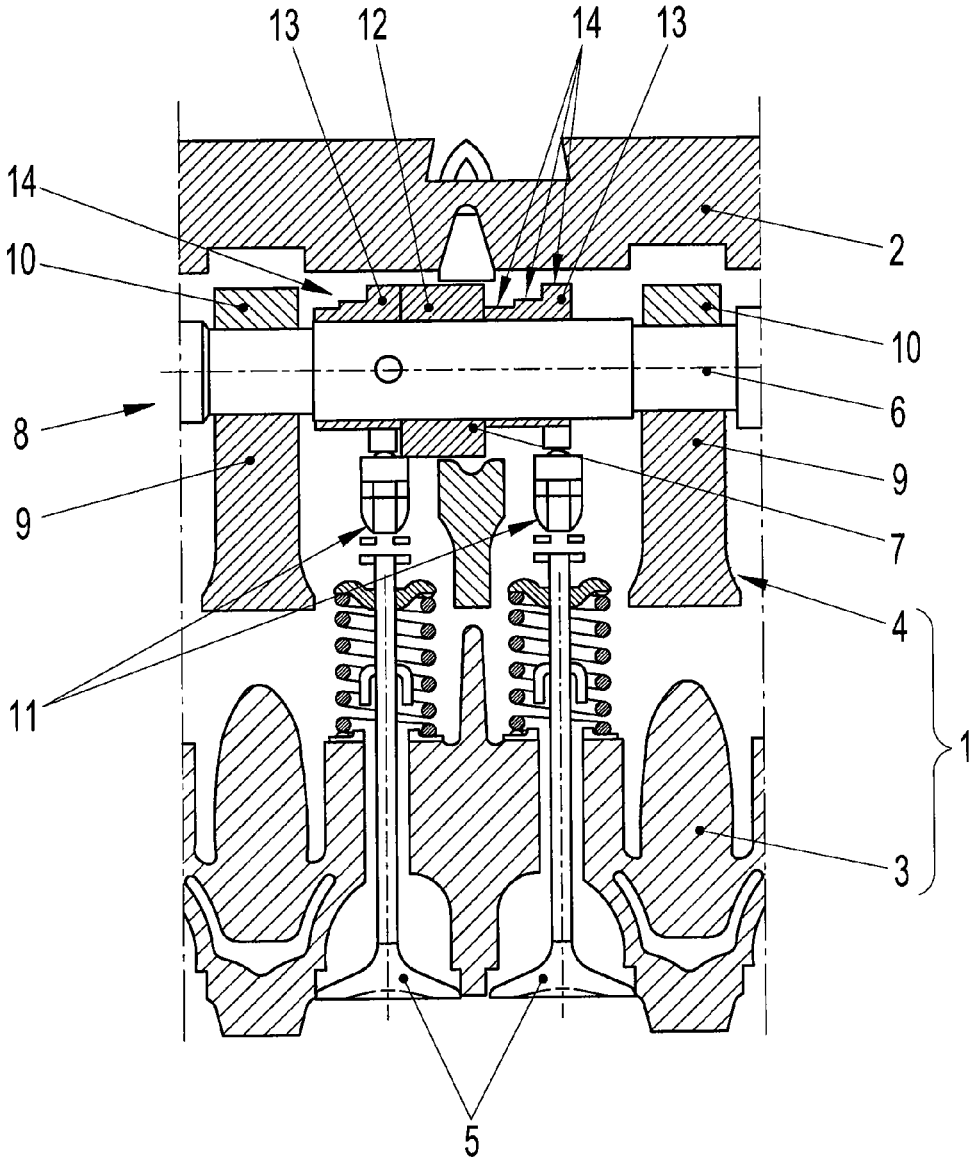
FIG. 1 shows a schematic cross section through an internal combustion engine in the region of a valve drive.

FIG. 1 shows a detail of a cross section through an internal combustion engine in the region of a cylinder head 1 which is bounded on the outside by a cylinder head cover 2. The cylinder head 1 is composed of a cylinder head lower part 3 and a camshaft housing 4.

According to FIG. 1, an inlet camshaft 6 is mounted in the camshaft housing 4 in order to control inlet valves 5 of the internal combustion engine. An outlet camshaft (not shown) is mounted in the camshaft housing 4 in order to control outlet valves (not shown) of the internal combustion engine.

Preferably two inlet valves 5 and two outlet valves (not shown) are provided per cylinder, wherein the inlet valves 5 are activated under control in a known fashion by the inlet camshaft 6. The outlet valves (not shown) are activated under control in a known fashion by the outlet camshaft (not shown). For this purpose, the inlet camshaft 6 which is mounted in the camshaft housing 4 or the outlet camshaft (not shown) respectively has a plurality of sliding cams 7.

In order to mount the inlet camshaft 6 in a way which can be seen in FIG. 1, radial bearing devices 8 are provided which comprise a lower bearing ring body 9 which is embodied in one piece with the camshaft housing 4 in the exemplary embodiment shown. Furthermore, each radial bearing device 8 has a bearing cover 10 which is attached to the lower bearing ring body 9 with the aid of, for example, screws on the camshaft housing 4.

According to FIG. 1, the inlet camshaft 6 activates the inlet valves 5 with the aid of roller cam followers 11. The sliding cam 7 is formed from a sliding block section 12 which is positioned in the center and two outer cam sections 13.

Each outer cam section 13 comprises three cam tracks 14, wherein a different valve stroke is set with each of the cam tracks 14. The illustrated sliding cam 7 accordingly comprises a cam section 13 with three cam tracks 14, which is axially displaceable, for each valve.

Each sliding cam 7 is assigned an actuator 15 which has pins 16, 17 which interact with the sliding block section 12 of the sliding cam 7. As a result, the sliding cam 7 is displaced axially in a region between two camshaft bearings. The axial displacement of the sliding cam 7 causes the respective valve to be selectively activated with a specific cam track 14, with the result that a different valve stroke setting is brought about.

Figure 2:
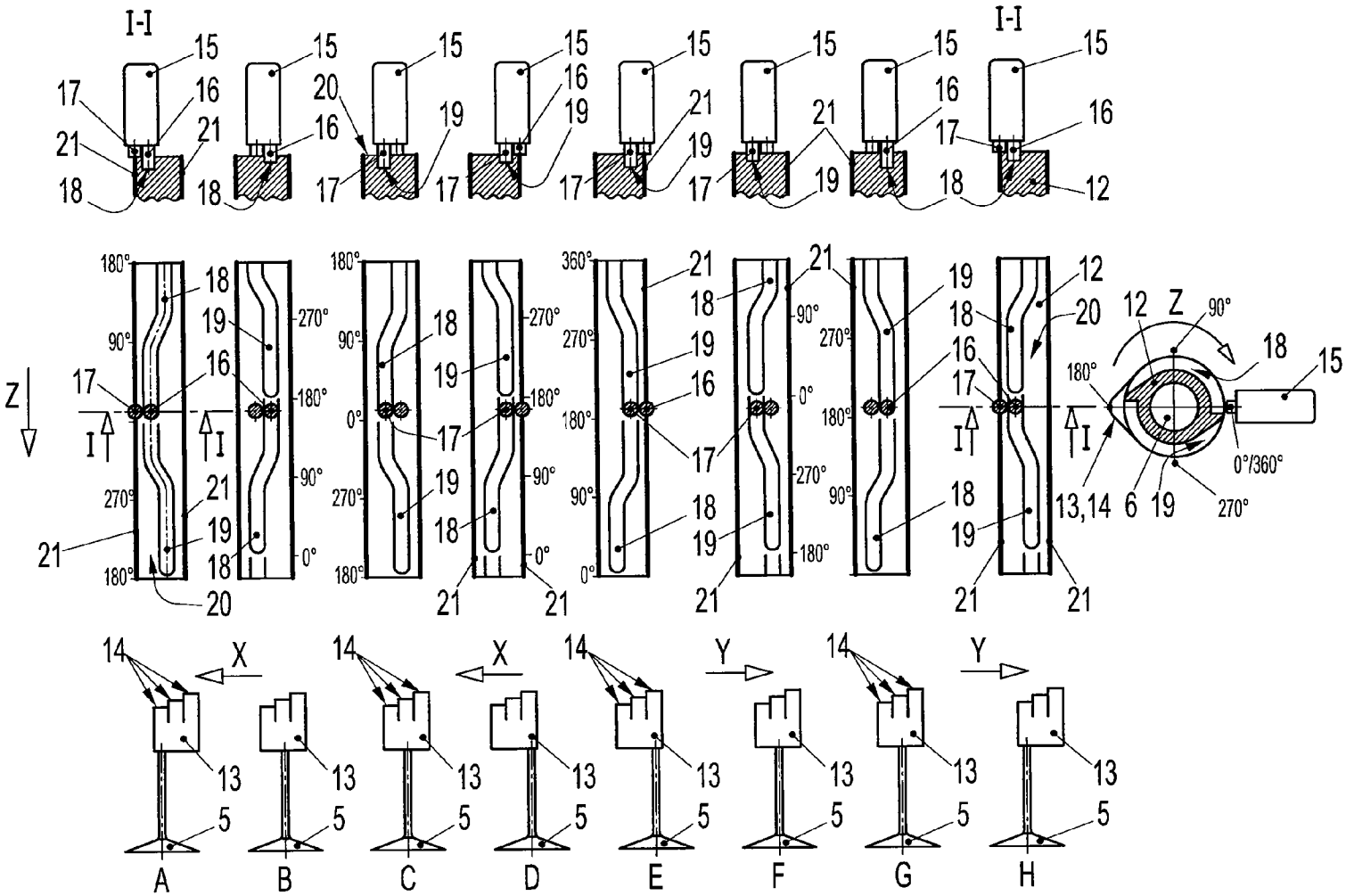
FIG. 2 shows a schematic diagram clarifying the method of functioning of the sliding block section of the sliding cam and of the actuator which interacts with the sliding block section.

Details of the axial displacement of the sliding cam 7, which is brought about by the interaction of the sliding block section 12 of the respective sliding cam 7 with the respective actuator 15, emerge from the schematic diagram in FIG. 2, wherein FIG. 2 shows, in addition to a detail of a cross section through the sliding block section 12 of the sliding cam 7, a developed view of the sliding block section 12, in each case together with the axial relative position of a cam section 13 relative to an inlet valve 5 which is to be activated and together with an actuator 15. The inlet valve 5 can be activated by one of the cam tracks 14 of the cam section 13 as a function of the axial relative position of the cam section 13 with respect to the inlet valve 5.

According to FIG. 2, the sliding block section 12 of the axially displaceable sliding cam 7 comprises a plurality of grooves which are positioned one behind the other in the circumferential direction of the sliding block section 12 and therefore on the circumference of the sliding cam 7, specifically a first groove 18 for axial displacement of the sliding cam 7 in a first axial direction and a second groove 19 for axial displacement of the sliding cam 7 in an opposing second axial direction.

The grooves 18 and 19 which are positioned one behind the other in the circumferential direction of the sliding block section 12 are each contoured here in an S shape, wherein these grooves 18 and 19 are formed one behind the other on the sliding block section 12 in the circumferential direction on an outer lateral face 20 of the sliding block section 12, and accordingly extend over different circumferential sections of the sliding cam 7 and therefore of the sliding block section 12.

The first groove 18, which is contoured in an S shape, causes the sliding cam 7 in the diagram of FIG. 2, and therefore the cam section 13 shown in FIG. 2, to be displaced to the left according to the arrows X, while the second groove 19, which is contoured in an S shape and which is positioned behind the first groove 18 in the circumferential direction, causes the sliding cam 7 to be displaced according to the arrows Y, and therefore causes the cam section 13 to be displaced to the right. Both of the grooves 18 and 19 which are contoured in an S shape define together a sliding block section 12 which is contoured in a double S shape.

The actuator 15, which interacts with the sliding block section 12, specifically with the grooves 18 and 19 of the sliding block section 12, has the two pins 16 and 17.

The pins 16 and 17 of the actuator 15 are latched in a housing of the actuator 15, for example according to the manner known from DE 10 2008 060 166 A1, which is incorporated by reference, using latching elements embodied as latching balls, and can be released by energizing an electromagnet of the actuator 15 in order to move the pins 16 and 17 axially in the radial direction of the sliding block section 12 or sliding cam 7. Both pins 16 and 17 are unlocked simultaneously by the electromagnet. As is described below in greater detail, a first pin 16 serves to displace the sliding cam 7 axially in both directions X and Y by a first axial segment in each case, while a second pin 17 serves to displace the sliding cam 7 in both directions X and Y by a second axial segment.

In the first axial segment of the axial displacement of the sliding cam 7, relative axial movement of the sliding cam 7 and therefore of the cam section 13 shown in FIG. 2 occurs relative to an inlet valve 5 between a cam track 14, which brings about a relatively small stroke of the respective inlet valve 5, and a cam track 14, which brings about a medium-sized stroke of the respective inlet valve 5, wherein in FIG. 2 the movement of the sliding cam 7 and therefore of the cam section 13 shown occurs between the states A and B as well as the states G and H in this first axial segment. In the second axial segment of the axial displacement of the sliding cam 7, relative axial movement of the sliding cam 7 and therefore of the cam section 13 shown in FIG. 2 occurs relative to an inlet valve 5 between the cam track 14, which brings about the medium-sized stroke of the respective inlet valve 5, and a cam track 14 which brings about a relatively large stroke of the respective inlet valve 5, wherein in FIG. 2 the movement of the sliding cam 7 and therefore of the cam section 13 shown occurs between the states C and D as well as the states E and F in this second axial segment.

The above transitions respectively differ in the direction of the axial movement of the sliding cam 7 and therefore of the cam section 13 shown, to be precise in such a way that a movement of the cam section 13 shown in FIG. 2 respectively occurs in the direction X to the left between the states A and B and the states C and D, and a movement of said cam section 13 respectively occurs in the direction Y to the right between the states E and F as well as G and H.

Then, if the cam section 13 is to be moved in FIG. 2 from the state A, that is to say from a state with the active cam track 14 for the relatively small stroke of the respective inlet valve 5, into the state B, that is to say into a state with the active cam track 14 for the medium-sized stroke of the respective inlet valve 5, if therefore an axial movement of the sliding cam 7 is to occur in the first direction X in the first axial segment, the first pin 16 of the actuator 15 is moved into engagement in the first groove 18, wherein by rotating the camshaft 6 and therefore the sliding cam in the rotational direction Z shown in FIG. 2 relative to the fixed actuator 15 and pin 16 which is attached thereto the sliding cam is moved in the first axial direction X in the first axial segment.

If the sliding cam 7 and therefore the cam section 13 are moved further axially in this first axial direction X, that is to say are transferred from the state C into the state D and therefore displaced in the second axial segment, the second pin 17 of the actuator 15 is introduced into the first groove 18, wherein, by rotating the camshaft 6 and therefore the sliding cam 7 in the rotational direction Z relative to the fixed pin 17, the sliding block section 12 and therefore the sliding cam 7 are moved further in this first axial direction X in the second axial segment.

The second groove 19 of the sliding block section 12 serves to move the sliding cam 7, and therefore the cam section 13, in the opposing, second axial direction, wherein in order to displace the sliding cam 7 axially in the second direction Y in the second axial segment, that is to say to move the cam section 13 from the state E into the state F, the second pin 17 of the actuator 15 interacts with said second groove 19, and wherein in order to move the sliding cam 7 in the second direction Y in the first axial segment, that is to say to move the cam section 13 from the state G into the state H, the first pin 16 of the actuator 15 interacts with said second groove 19.

As already stated, the two grooves 18 and 19, which are each contoured in an S shape, are positioned one behind the other in the circumferential direction of the sliding block section 12, with the result that said grooves 18 and 19 accordingly extend over different circumferential sections of the sliding block section 12 and therefore of the sliding cam 7. Both grooves 18 and 19 thereby extend over a circumferential section of, in each case, approximately 180° of the sliding block section 12 (see FIG. 2).

It accordingly follows from the above relationships that either the first groove 18 or the second groove 19 of the sliding block section 12 is used in an interplay with one of the pins 16 and 17 of the actuator 15 as a function of the desired direction X or Y of the axial displacement of the sliding cam 7 on the camshaft 6. In order to displace the sliding cam 7 in the first axial direction X, one of the pins 16 and 17 engages in the first groove 18. In order to displace the sliding cam 7 in the second axial direction Y, one of the pins 16 or 17 engages in the second groove 19 of the sliding block section 15.

Either the first pin 16 or the second pin 17 of the actuator 15 engages in one of the grooves 18 and 19 of the sliding block section 12 of the sliding cam 7 as a function of the desired axial segment of the axial displacement of the sliding cam 7. For the axial displacement of the sliding cam 7 in the first axial segment, that is to say in order to move the cam section 13 between a position which brings about a small valve stroke and a position which brings about a medium-sized valve stroke, and vice versa, the first pin 16 is in engagement with one of the grooves 18 and 19 as a function of the desired direction. In order to bring about axial displacement in the second axial segment, that is to say in order to move the cam section 13 from a position which brings about a medium-sized valve stroke into a position with a large valve stroke, and vice versa, the second pin 17 is in engagement with one of the grooves 18 and 19 of the sliding block section 12 as a function of the desired direction of the axial displacement.

In order to permit simple, certain and reliable detection of the relative position of the sliding cam 7 on the camshaft 6 and therefore of the cam tracks 14 of the cam section 13 with respect to the inlet valve 5 which is to be activated, the sliding block section 12, which provides the grooves 18 and 19 which interact with the pins 16, 17 of the actuator 15 in order to bring about axial displacement of the sliding cam 7, is manufactured in certain sections from a material with a relatively high electrical conductivity or from an electrically conductive material and in certain sections from a material with a relatively low electrical conductivity or from an electrically nonconductive and therefore electrically insulating material.

The pins 16 and 17, preferably manufactured from an electrically conductive material, of the actuator 15 interact with those regions or sections of the sliding block section 12 which are manufactured from different materials, wherein the relative position of the sliding cam 7 on the camshaft 6 and therefore of the cam track 14 of the cam section 13 relative to the inlet valve 5 which is to be activated can then be detected from this interaction in a simple and certain way.

The electrically conductive sections or regions of the sliding block section 12 are preferably fabricated from a metallic material, while the electrically nonconductive or electrically insulating sections of the sliding block section 12 are preferably fabricated from a plastic, in particular from polytetrafluoroethylene.

In the preferred exemplary embodiment of the invention which is shown, the sliding block section 12 of the sliding cam 7 is fabricated in the region of its grooves 18 and 19, and directly axially next to the grooves 18 and 19, from the material with the relatively high electrical conductivity or the electrically conductive material, preferably from a metallic material. In contrast, in the region of its axial ends 21 the sliding block section 12 of the sliding cam 7 is fabricated from the material with the relatively low electrical conductivity or the electrically insulating material, preferably from a plastic.

According to one advantageous development of the invention, both pins 16 and 17 of the actuator 15 are connected to an electrical test voltage potential via a preferably common and therefore single-conductor, electrical feed line, wherein the level of the flowing electrical test current is dependent on whether the pins 16 and 17 both bear on an electrically conductive region of the sliding block section 12 (see, in particular, states B, C, F and G in FIG. 2) or whether one of the pins 16 or 17 bears on an electrically insulating region of the sliding block section 12 (see, in particular, states A, D, E and H in FIG. 2).

Both pins 16 and 17 of the actuator 15 are preferably assigned a common sensor, for example a sensor which is embodied as a Hall sensor, with the aid of which it can be detected whether one of the pins 16, 17 projects into one of the grooves 18, 19.

Through common evaluation of the flowing electrical test current with the signal of the sensor which is preferably embodied as a Hall sensor, it is then possible in an easy and reliable fashion to infer the movement of the sliding cam 7 on the camshaft 6 or of the cam section 13 relative to the inlet valve 5 which is to be activated, between the states shown in FIG. 2, and therefore to infer the relative position of the cam tracks 14 relative to the inlet valve 5 which is to be activated, in particular on the basis of the following logical matrix:

| | Displacement State A to B | Displacement State C to D | Displacement State E to F | Displacement State G to H |
|---|---|---|---|---|
| Pin 16 insulating on lateral face 20 | X | | | |
| Pin 16 conductive on lateral face 20 | | | | X |
| Pin 16 conductive in groove 18/19 | | X | X | |
| Pin 17 insulating on lateral face 20< | | | X | |
| Pin 17 conductive on lateral face 20 | | X | | |
| Pin 17 conductive in groove 18/19 | X | | | X |

The invention accordingly permits the relative position of the cam tracks 14 with respect to the inlet valve 5 which is to be activated to be determined in an easy and reliable way, and therefore permits the cam track 14 which is active during the actuation of the inlet valve 5 to be determined.

LIST OF REFERENCE NUMBERS

1 Cylinder head
2 Cylinder head cover
3 Cylinder head lower part
4 Camshaft housing
5 Inlet valve
6 Inlet camshaft
7 Sliding cam
8 Radial bearing devices
9 Bearing ring body
10 Bearing cover
11 Roller cam follower
12 Sliding block section
13 Cam section
14 Cam track
15 Actuator
16 Pin
17 Pin
18 Groove
19 Groove
20 Lateral face
21 End

What is claimed:

1. A valve drive for an internal combustion engine having a plurality of cylinders comprising:

at least one camshaft to activate gas exchange valves of the internal combustion engine, the at least one camshaft having at least one sliding cam which is configured to be displaced axially on the camshaft, wherein the at least one sliding cam has a sliding block section with a plurality of grooves which are formed on an outer lateral face of the sliding block section and are positioned one behind the other on a circumference of the sliding block section, the plurality of grooves including a first groove for axial displacement of the sliding cam in a first direction and a second groove for axial displacement of the sliding cam in an opposing second direction, an actuator with a plurality of pins which are configured to be activated in order to bring about axial displacement of the respective sliding cam, the plurality of pins including a first pin for axial displacement of the sliding cam in the first and second directions about a first axial segment and a second pin for axial displacement of the sliding cam in the first and second directions about a second axial segment, and wherein, for an axial displacement of the sliding cam, both the first pin and the second pin are released from the actuator and moved axially radially inward in a radial direction of the sliding cam in a way that one of the pins projects into a groove of the sliding block section, while the other pin bears on an radially outer lateral face of the sliding block section, wherein the sliding block section includes sections having a high electrical conductivity and other sections having a low electrical conductivity.

2. The valve drive as claimed in claim 1, wherein the sliding block section includes sections that are electrically conductive and other sections that are either electrically nonconductive or are electrically insulating.

3. The valve drive as claimed in claim 2, wherein the electrically conductive sections are metallic.

4. The valve drive as claimed in claim 2, wherein the electrically insulating sections are formed from plastic.

5. The valve drive as claimed in claim 4, wherein the electrically insulating sections are formed from polytetrafluoroethylene.

6. The valve drive as claimed in claim 1, wherein the sliding block section is formed in a region of its grooves as well as axially next to the grooves from a material with a high electrical conductivity or an electrically conductive material, and wherein the sliding block section is formed in a region of its axial ends from a material with a low electrical conductivity or an electrically insulating material.

7. The valve drive as claimed in claim 1, wherein both pins of the actuator are formed from an electrically conductive material and are connected to an electrical test voltage potential via an electrical feed line, wherein a level of the flowing electrical test current is dependent on whether the pins both bear on an electrically conductive region of the sliding block section or whether one of the pins bears on an electrically insulating region of the sliding block section.

8. The valve drive as claimed in claim 1, wherein a common sensor is assigned to the two pins of the actuator, with the aid of which sensor to detect whether one of the pins projects into one of the grooves.

9. The valve drive as claimed in claim 1, wherein one of the pins of the actuator engages either in the first groove or in the second groove of the sliding block section as a function of a desired direction of the axial displacement of the sliding cam, and wherein either the first pin or the second pin engages in one of the grooves of the sliding block section as a function of a desired axial segment of the axial displacement of the sliding cam.

10. The valve drive as claimed in claim 1, wherein the first groove and the second groove of the sliding block section of the sliding cam are each contoured in an S shape.

* * * * *